United States Patent [19]

Müssig et al.

[11] Patent Number: 5,033,341

[45] Date of Patent: Jul. 23, 1991

[54] ALIGNMENT SYSTEM FOR TEXTILE WEBS

[75] Inventors: Karl Müssig; Martin Schnaus, both of Bad Konigshofen, Fed. Rep. of Germany

[73] Assignee: Texpa Arbter Maschinenbau GmbH, Saal/Saale, Fed. Rep. of Germany

[21] Appl. No.: 405,291

[22] Filed: Sep. 11, 1989

[30] Foreign Application Priority Data

Sep. 9, 1988 [DE] Fed. Rep. of Germany ..... 3830724

[51] Int. Cl.[5] ..... D06H 7/02

[52] U.S. Cl. ..... 83/18; 83/210; 83/367; 83/607; 83/937

[58] Field of Search ..... 83/209, 277, 367, 937, 83/949, 315, 316, 317, 597, 601, 605, 606-609, 18, 210

[56] References Cited

U.S. PATENT DOCUMENTS

| | | | |
|---|---|---|---|
| 3,701,299 | 10/1972 | Stumpf | 83/937 X |
| 3,823,629 | 7/1974 | Bleimund | 83/937 X |
| 3,831,472 | 8/1974 | Sasaki | 83/277 X |
| 4,034,634 | 7/1977 | Arbter | 83/277 X |
| 4,079,645 | 3/1978 | Nunes et al. | 83/277 X |
| 4,356,054 | 10/1982 | Götes | 83/277 X |
| 4,398,441 | 8/1983 | Jue | 83/607 X |
| 4,586,411 | 5/1986 | Koivula | 83/175 |
| 4,700,598 | 10/1987 | Gerber | 83/937 X |
| 4,781,087 | 11/1988 | Shibata | 83/368 X |
| 4,926,725 | 5/1990 | Helgesson | 83/277 X |
| 4,949,609 | 8/1990 | Sohtome et al. | 83/277 X |

FOREIGN PATENT DOCUMENTS

| | | |
|---|---|---|
| 497623 | 5/1930 | Fed. Rep. of Germany . |
| 1912023 | 3/1965 | Fed. Rep. of Germany . |
| 2653790 | 6/1978 | Fed. Rep. of Germany . |

*Primary Examiner*—Paul A. Bell
*Assistant Examiner*—Kenneth E. Peterson
*Attorney, Agent, or Firm*—Cushman, Darby & Cushman

[57] ABSTRACT

An alignment and cutting system for use with textile materials, such as terry cloth toweling fabric, to process either a single width of fabric or to simultaneously process in a side-by-side manner, a plurality of fabrics having the same or different widths. The system will also align each of that plurality of fabric regardless of whether the fabrics have the same or different lengths of nap-less bands or lanes separating the terry pile areas and can cut the same or different lengths of fabric from each of the plurality of fabrics being processed.

8 Claims, 7 Drawing Sheets

ALIGNMENT SYSTEM FOR TEXTILE WEBS

FIELD OF THE INVENTION

This invention relates to an alignment system for textile webs that ensures the proper and desired crosswise aligning of the textile webs and straight cuts. Portions of the textile webs are used for alignment purposes, such portions being disposed longitudinally along the textile web and spaced apart from one another. These portions may, for example, be the crosswise nap-free bands on terrycloth fabric, one edge of such bands forming a stop. The system includes an apparatus that takes the textile web from a bolt, a folder, a cutter, a straightener and an apparatus for retaining the textile web during the cutting processes. The aligning device has a number of raisable and lowerable aligning elements as a alignment means.

BACKGROUND OF THE INVENTION

Such a system is known from German Patent 25 44 410, U.S. Pat. No. 4,034,634. The difficulty with using this known system is that only one textile web at a time can be processed. Also, the folder in this known system makes for a shorter structural length. The aligning portion at the system is of a comprised number of aligning shoes, which are supported resiliently in a raisable and lowerable strip that is situated crosswise to the path of motion of the textile material. When aligning a crooked textile web, the aligning shoes are lowered into a nap-free band and then displaced in the take-off direction of the textile web. In the course of this movement, the aligning shoes will come into contact with the leading edge of the nap-free band or lane and in so doing will straighten the textile material and shape it to be parallel to a cutting knife. During the alignment process, the forces exerted on the textile web will tension the textile material being aligned with cutting occurring in the tensioned portion.

In order to increase the production level, two of the known machines may be placed side by side and operated synchronously. A double system of this kind would be relatively expensive, however, as well as complicated to adjust and operate. A further consideration is that in this double system, work can only be done with two textile webs, no fewer. The situation may arise, however, where it is desired to work with only one web, but one having a relatively wide width.

OBJECT AND SUMMARY OF THE INVENTION

It is therefore the object of the present invention to devise a system that is relatively simple to adjust and operate, by means of which one or more crooked textile webs can be selectively straightened and cut to length at the same time. The webs may have the same or different web widths. Furthermore, in working with multiple webs, it is possible to cut either identical or different fabric lengths (so-called repeat lengths).

According to the invention, this object is attained in that the system selectively straightens and cuts one or more identical or different textile webs extending parallel to one another and in a side-by-side relationship.

The folder, embodied as an additional take-off apparatus, the straightener and the retainer are divided laterally into segments, which are associated with the various webs and are also separately controllable and adjustable.

When only one web is being processed, the laterally divided segments of the folder, straightener and retainer, are controllable or adjustable to extend parallel to one another, such that synchronous operation is possible.

The segments of the additional take-off apparatus cooperate with corresponding segments of the straightener that are lowered onto the textile web or webs, and the take-off apparatus and cutter each extend continuously transversely across the system, or are laterally divided into segments in accordance with the individual webs, but are located all in the same line and are actuated in common.

According to the invention, a system with these characteristics can be used advantageously either with only one web or with a plurality of webs. In the latter case, the webs may have the same or different widths, and the length of the pieces of fabric to be cut from the webs (repeat lengths) may be the same or different lengths.

Conversely, if only one web is being processed in the system, its width may be relatively great.

The system according to the invention is moreover relatively simple to adjust and operate, and is also more economical than two of the known systems set up side by side. It is preferable that the take-off apparatus and cutter extend in one line transversely across the web, so that the cut edges of the pieces of fabric cut from a plurality of webs are located all in the same line, which is important when these cut edges are hemmed and sewn in ensuing processes. The take-off apparatus pulls off a predetermined length of the web or the desired length of each of the webs, but this length is shorter than the length of the cut pieces of fabric (repeat lengths). Where a plurality of webs are being handled, the repeat lengths may be the same or different. The difference between the pulled off length and the desired repeat length is made up for by the folder which takes-off an additional length of the textile during the alignment operation and thereby acts as an additional take-off apparatus.

Associated with each segment of the additional take-off apparatus are scanning means, for instance photoelectric cells, which control the segments in such a way that the correct remaining length will be taken from the web.

If only one web is being processed in the system, the segments of the additional take-off apparatus are indexed in parallel. Whether only one web or a plurality of webs is being processed, the cut is made absolutely straight at the correct point of the web or webs once the alignment operation has been completed. Alignment of the textile to permit straight cuts of the web or webs is effected by the relative movement between the textile material or webs and the aligning elements. The aligning elements are lowered onto the webs, and in the case of terrycloth toweling fabric cooperate with the edge of the raised terry or pile on one side of the nap-free bands in the fabric during the time that the additional take-off apparatus is in operation.

Once the alignment operation is completed, a retainer comes into play, to briefly fix the position of the web or webs so they can be cut by the cutter. The retainer continues to fix the position of the web for a brief period following the cutting operation. Once the cut has been made, then in the case of more than one web, the cut-off pieces of fabric can be transported transversely to the direction of transport of the webs to further processing stations, such as hemming and sewing of the cut edges.

The system can also be used to straighten textile webs that have weft-free segments at predetermined intervals, for example, into which needle-like aligning elements can be lowered for aligning crooked webs.

It is advantageous for the laterally divided segments of the alignment system to be situated such that they are adjustable independently of one another in the longitudinal direction of the webs. As a result, the various segments of the straightener can be simply adjusted to different widths of nap-free bands in terrycloth fabric. When they are so adjusted these straightener segments are staggered relative to one another when viewed in the transverse direction of the webs.

Another feature of the invention is that the laterally divided segments of the alignment system are individually adjustable at oblique angles to the webs, making it possible to straighten even badly misaligned webs.

Still another feature of the invention provides that the retainer segments also serve as feed segments for the web or webs and are actuatable either in common, or independently of one another. The retainer segments thus have a dual function, on the one hand fixing the web or webs both while a cut is being made and briefly thereafter, and on the other hand once the cut has been made advancing the web or webs somewhat farther in the transport direction, so that the cut edge or edges can be engaged in the next operating cycle by the take-off apparatus. Since the various segments of the retainer can also be actuated independently of one another it is possible that if a flaw appears in one of the webs, it is possible to advance only the flawed web, so that only that web is engaged by the take-off apparatus and the flawed length can be pulled off while the other webs are stopped by the retainer.

Other objects, features, and characteristics of the present invention, as well as the methods and operation and functions of the related elements of the structure, and to the combination of parts and economies of manufacture, will become apparent upon consideration of the following description and the appended claims with reference to the accompanying drawings, all of which form a part of this specification, wherein like reference numerals designate corresponding parts in the various figures.

DESCRIPTION OF THE PREFERRED EMBODIMENTS

Figure 1:
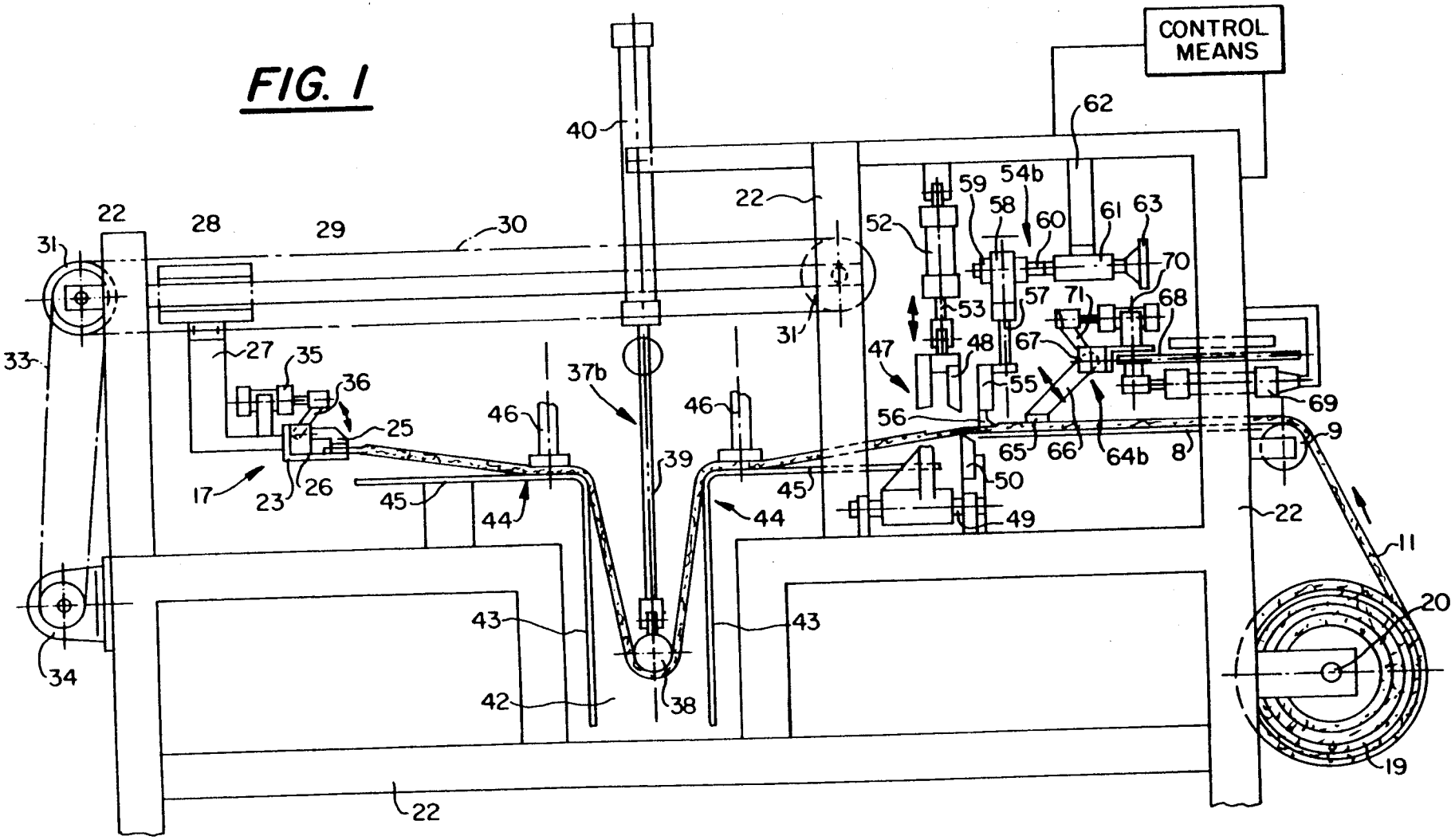
FIG. 1 is a schematic side view of a system that straightens and cuts one or two misaligned webs of fabric selectively, at the end of a alignment operation (with portions cut away for clarity)
Figure 2:
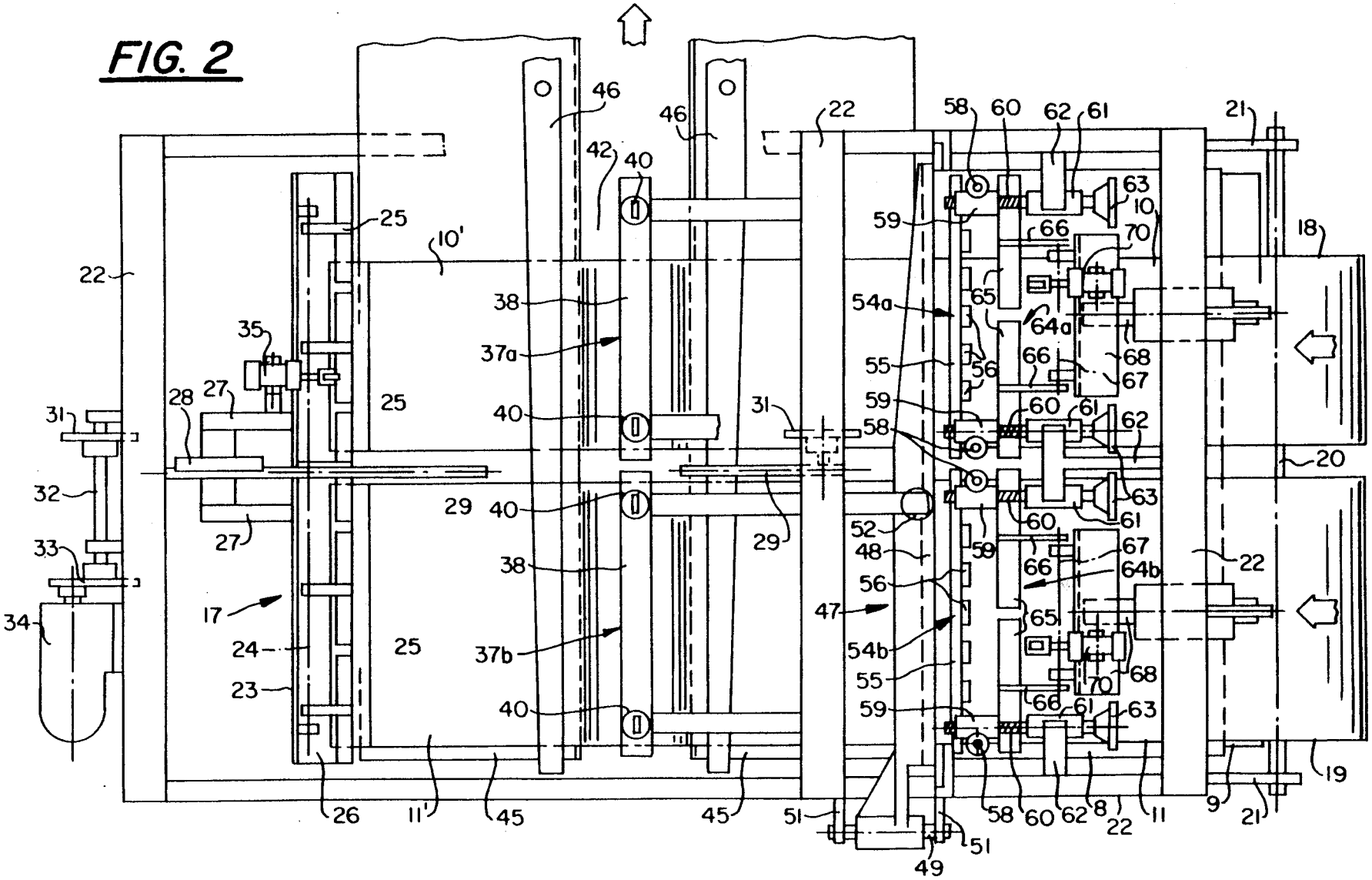
FIG. 2 is a plan view of the system shown in FIG. 1, with part of the transport apparatus for removing the cut pieces of fabric in a direction transverse of the transport of the two webs.
Figure 3:
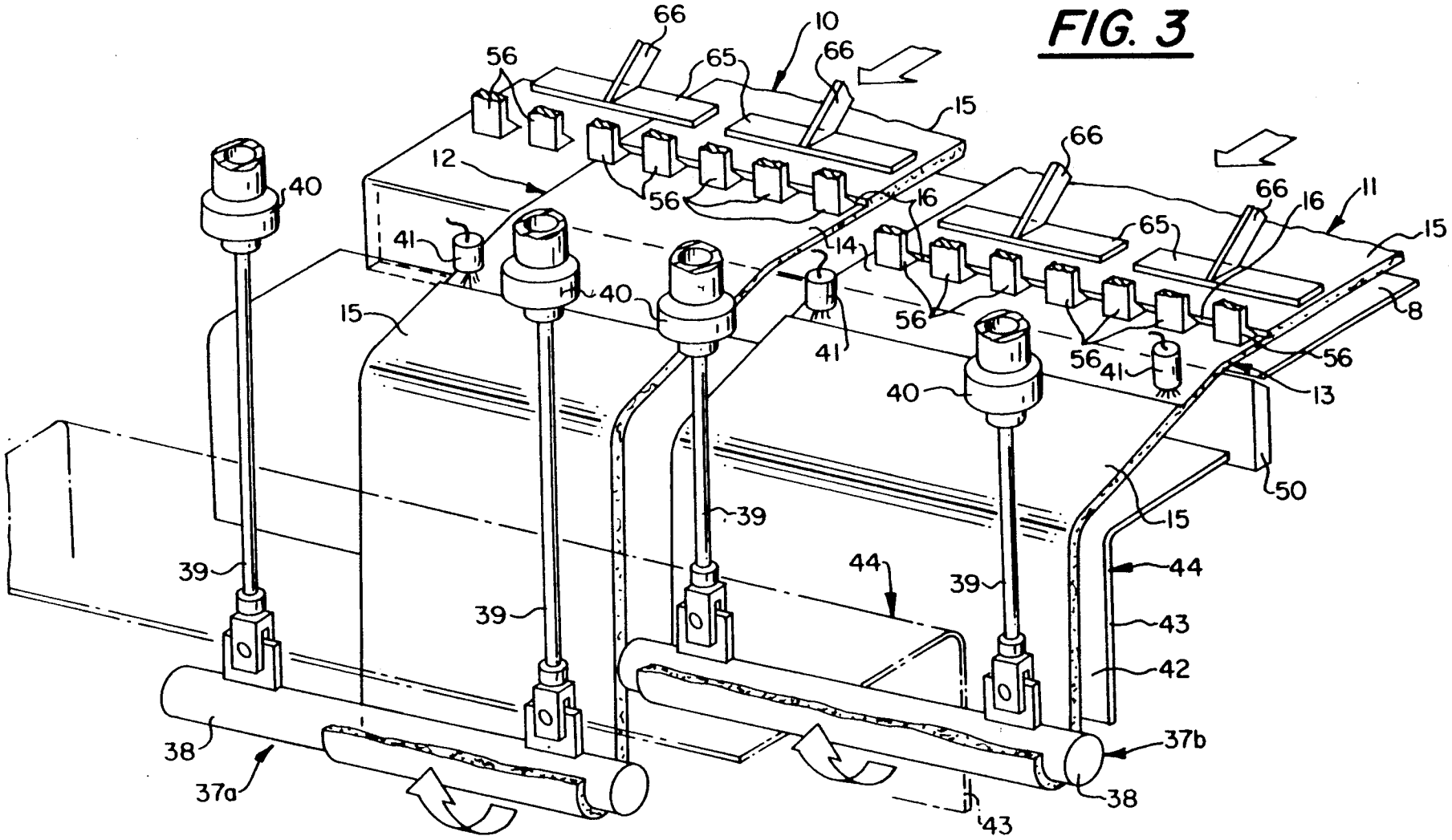
FIG. 3 is an oblique view of the additional take-off apparatus with the aligning elements lowered onto the two webs at the conclusion of the alignment operation and just before the cutting operation.
Figure 5:
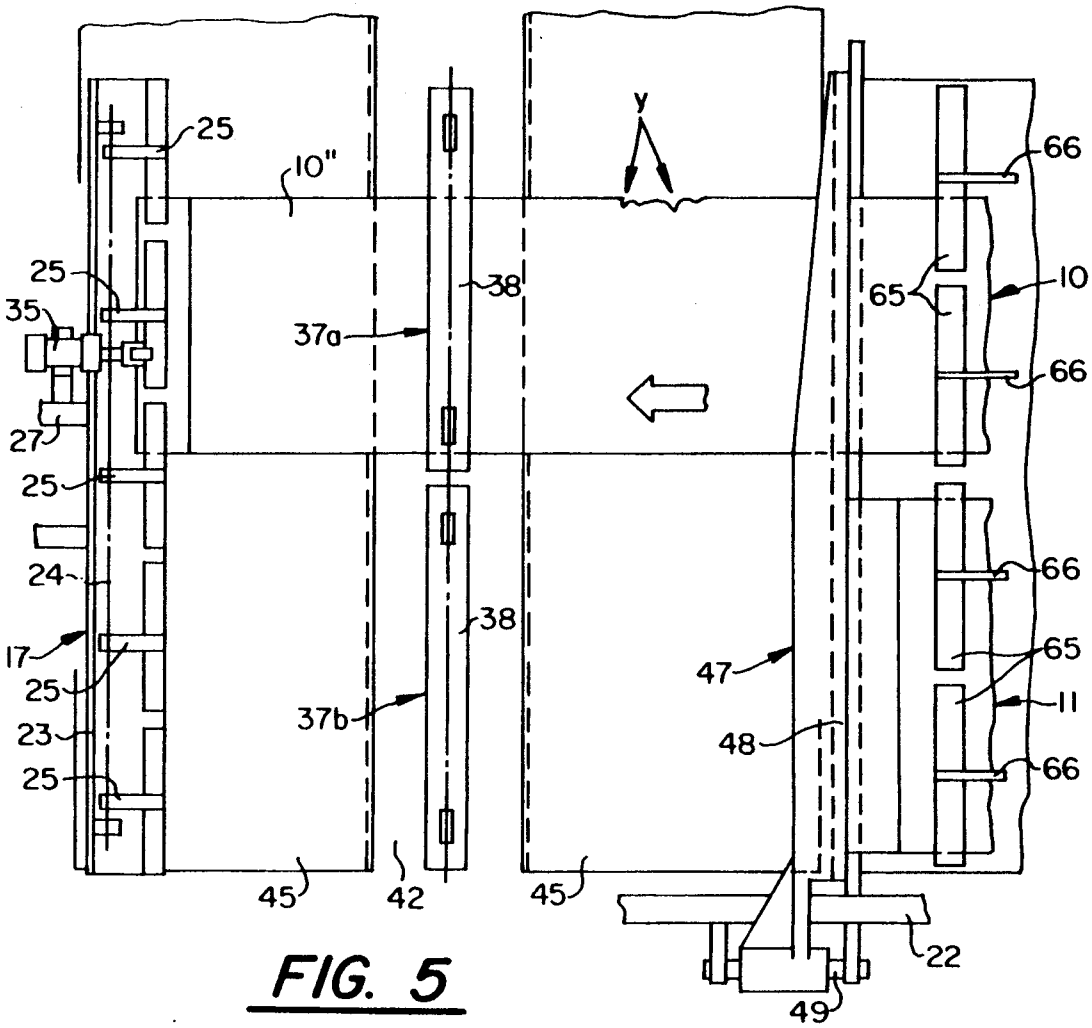
FIGS. 4 and 5 each show a plan view of a part of the system shown in FIGS. 1 and 2 while a portion of only one web having a flaw is taken off and cut, while the other web is retained by the retainer, for the sake of simplicity the alignment system is not shown in these drawings.
Figure 6:
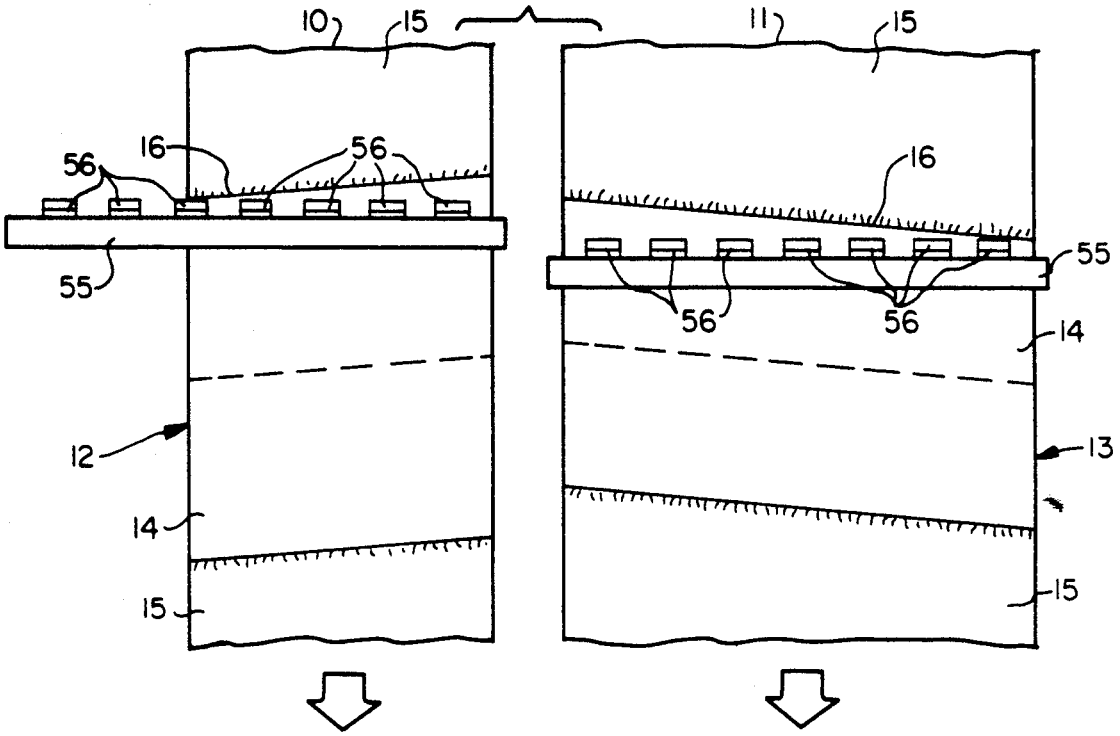
FIG. 6 is a partial plan view of the two webs depicted in FIG. 2 in a misaligned state prior to alignment, with the aligning strips already lowered.
Figure 7:
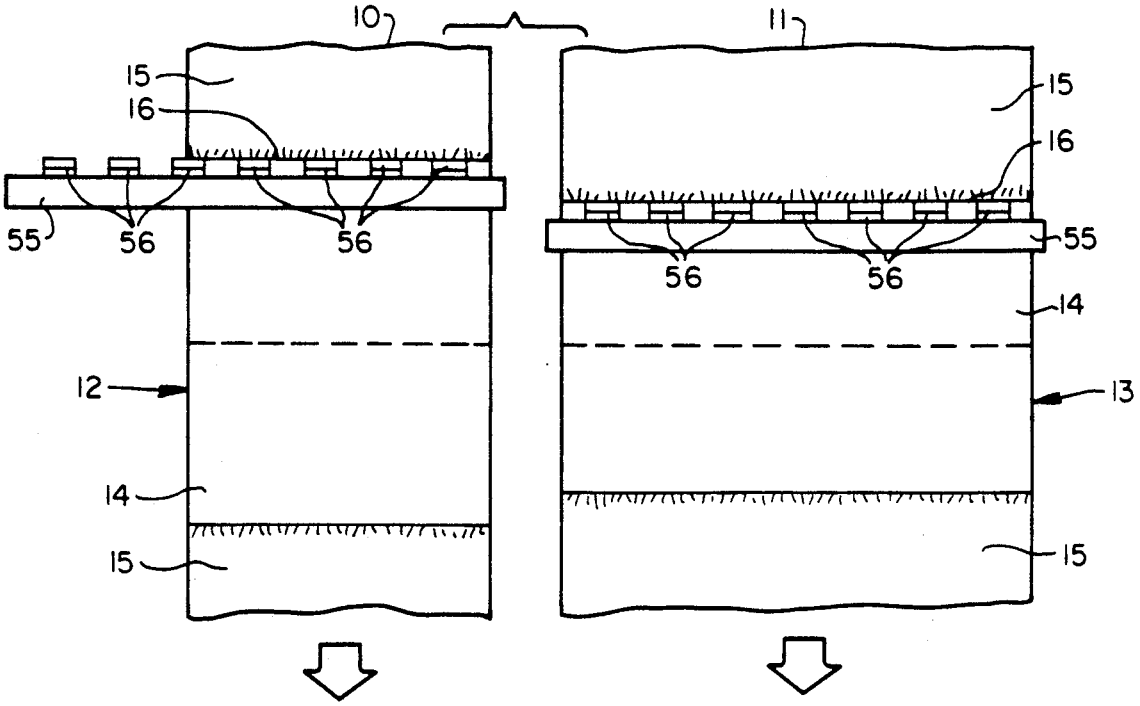
FIG. 7 is a plan view of the two webs of FIG. 6 after the alignment and just before the cutting operation.
Figure 10:
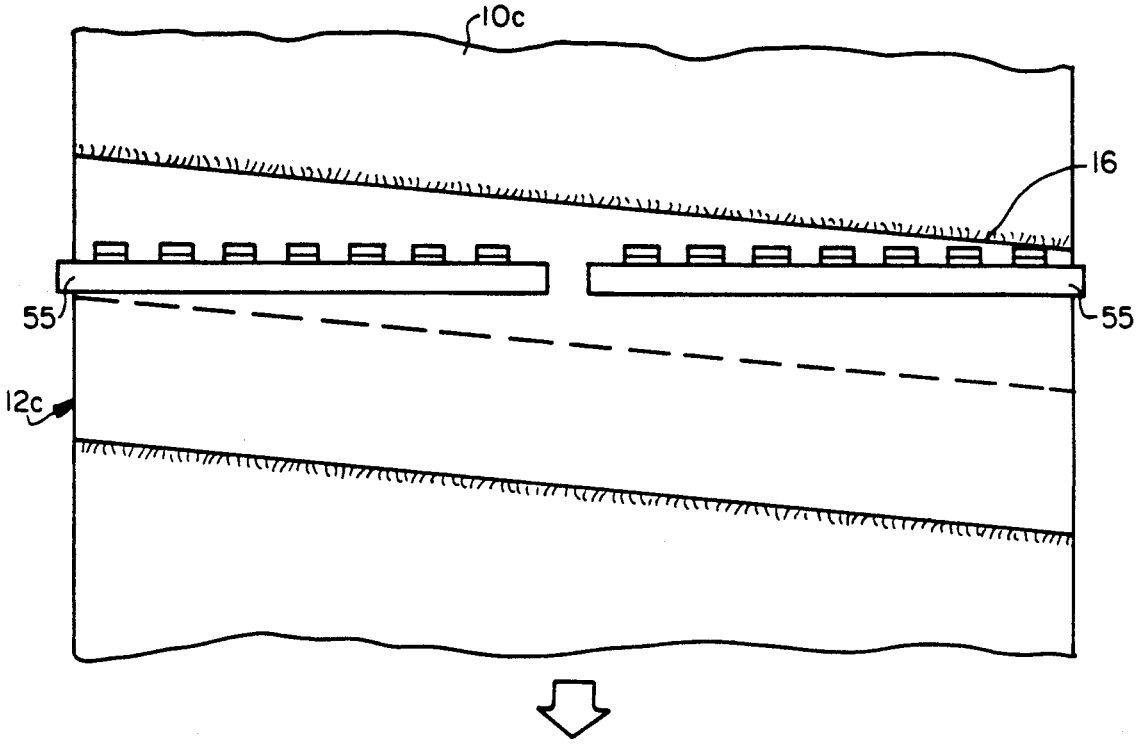
FIG. 10 is a plan view on a portion of a single web in the misaligned state prior to the alignment operations shown in FIGS. 1–3.
Figure 11:
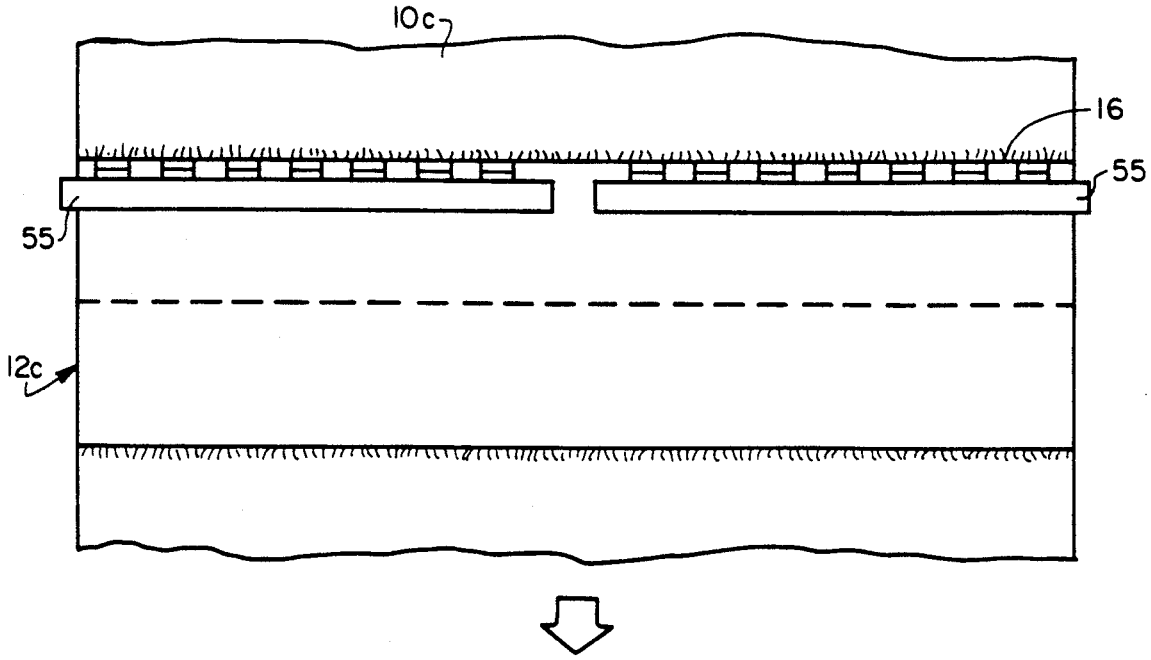
FIG. 11 is a plan view of the portion of the web shown in FIG. 10 after the alignment and before the cutting operation.

The system selected as an exemplary embodiment and shown in FIGS. 1–5 is designed for processing either a relatively wide textile web, as shown at 10*c* in FIGS. 10, 11, or for processing multiple textile webs running in parallel. For example, two textile webs 10 and 11, which are correspondingly narrower, are shown in FIG. 3. In the exemplary embodiment these webs 10 and 11 have different widths but may also be of the same width. The webs 10 and 11 can be comprised of terrycloth fabric having nap-free bands 12, 13. The textile material of the webs 10, and 11 has a continuous foundation weave, 14, that is visible in the nap-free bands 12, 13 (FIGS. 3, 6, 7). The napped portions of the two webs 10, 11 that are interrupted by the nap-free bands 12, 13 are designated by reference number 15. The width of the nap-free bands 12 and 13 are uniform for each web 10, 11. The lengths of the pieces of fabric 10', 11' (FIG. 2) to be cut from the webs 10 and 11, which for instance may later be made into hand towels, are identical for each web 10, 11, but these lengths may be either of the same length or of a different length. These lengths are the so-called repeat lengths. These repeat lengths extend from the middle of each nap-free band 12 or 13 to the middle of the next nap-free band 12 or 13. Reference number 16, as in FIG. 3, indicates the trailing edge of the nap-free bands 12, 13, at which point the terry pile serves as a stop which cooperate with the aligning elements, as is described in further detail below.

With reference to FIGS. 1 and 2, the webs 10, 11 are drawn into the system in the direction of the arrow, by a take-off apparatus generally shown at 17 from a supply which can be, for example, a folded pile of material, a supply in a truck or other container or from a roll or bolts as shown at 18, 19. This take-off apparatus, 17, would normally draw from both bolts simultaneously and the material drawn from bolt 18 would be drawn parallel to the material drawn from bolt 19. The bolts 18 and 19 are rotatably supported on a shaft 20, which is supported by two arms 21 that are secured in turn to the frame 22 of the system.

As already mentioned, the take-off apparatus 17 can pull both webs 10, 11 into the system simultaneously, and in the exemplary embodiment the take-off apparatus, 17, would draw the textile across the working width of the aligning portion of the system. In detail, this take-off apparatus 17 includes an angle rail 23, which supports a shaft 24, suggested only by dot-dash lines in FIGS. 1 and 2, in such a way that the shaft can rotate; a plurality of take-off clamps 25 are secured at spaced apart portions from one another along shaft 24. When the webs 10, 11 are being drawn from their supply bolts 18, 19, these take-off clamps 25 cooperate with the horizontal legs 26 of the angle rail 23 so that one edge of the webs will be gripped therebetween. The angle rail 23 is carried by two arms 27, which are secured to a carriage 28. Carriage 28 is in turn movably supported on a rod 29 situated horizontally on the frame 22, so that carriage 28 can move back and forth in the axial direction of the aligning portion of the system. The reciprocation of carriage 28 is effected, for example, in the exemplary embodiment by a drive chain 30, which runs over sprocket wheels 31 rotatably supported on the frame 22. Wheel 31 on the left in FIGS. 1 and 2 can be a drive wheel and driven, for example, via a shaft 32 and an endless chain 33 driven in turn by a drive motor 34, which is reversible in its direction of rotation. Drive motor 34 is secured to the frame 22. Alternatively, take-off apparatus 17 can be driven by the main drive motor of the system.

The take-off clamps 25 are pivotally movable between open and closed conditions, their working closed position being shown in FIG. 1. Movement between their open and closed positions is effected by an actuating cylinder 35, which may be a compressed air cylinder or other suitable device, and the piston rod of which is pivotably connected to a lever 36, which in turn is secured to shaft 24. The actuating cylinder 35 and the drive motor 34 are activated under automatic control by a follow-up control, as will be described later.

The take-off apparatus 17 always pulls a predetermined length of the textile webs 10, 11 into a system. This length is shorter than the repeat length and may vary from one web 10, 11 to the other. The lengths of textile material remaining to make up the precise repeat lengths are subsequently pulled into the system by an additional take-off apparatus or assembly, which is laterally divided into segments 37*a* and 37*b* that are independently controllable so that each can act on the respective webs 10 and 11. Each additional take-off apparatus is designed to cooperate with at least one textile web, where a plurality of panelled webs are being processed simultaneously, or to cooperate together where several of the additional take off assemblies are used on one web. The function of the additional take-off assemblies, spaced apart transversely across the machine, is to pull additional lengths of textile into the aligning system and to develop the desired aligning interaction and relative movement between the aligning shoes or feet 56 and the fabric. The additional take-up apparatus or assemblies can move or drive the fabric in a variety of ways including the use of drive rollers, independently operable, to differentially drive the fabric, where different fabric widths are involved, or to cooperatively move the fabric where two or more of the additional take-up assemblies operate on one web. The preferred apparatus for the additional take-up assemblies comprises a plurality of drop bars 38, each of which is pivotably connected to the lower ends of piston rods 39 of controlled actuating cylinders 40. The actuating cylinders 40, which may be compressed air cylinders or other suitable activating device, are secured to the frame 22 and are controlled in pairs by scanning elements 41, (FIG. 3). The scanning elements 41 can comprise, for example, photoelectric cells, which scan the nap-free bands 12, 13 of the webs 10, 11. These scanning elements 41 are adjustably secured to the frame 22. When the piston rods 39 are extended, the drop bars 38 drop into a chute 42 provided in the table across where the textile webs are drawn. Chute 42 can be defined by the vertical segments 43 of two metal sheets 44 bent at an angle and secured to the frame 22 so that the chute 42 is oriented transverse to the primary axis of the alignment portion of the system. In this process the bars 38 push the webs 10, 11 downwardly into the chute 42, forming folds, to a predetermined depth such that the desired repeat lengths for the single web or for each of the webs being processed are attained. Toward the end of this drop operation the crooked webs 10, 11 are also straightened, as will be described later. The horizontal segments 45 of the bent sheets 44 form bearing surfaces for the pieces of fabric 10', 11' cut from the webs 10, 11, and these pieces are then carried away in the direction of the arrow at the top of FIG. 2, which direction is transverse to the direction the webs 10, 11, are being drawn into the aligning portion of the system. The cut strips are carried by two transport devices, shown at 46.

Reference number 47 indicates a cutting apparatus, oriented so as to be transverse to the direction the textile webs are being drawn into the alignment portion of the system. This cutting apparatus 47 includes a cutting knife 48, pivotably supported on a horizontal shaft 49, as shown in FIG. 2, that cuts in cooperation with a stationary cutting knife 50 that is fixed to frame 22. The shaft 49 is pivotally secured to frame 22 via two arms 51. The pivoting motion of knife 48 upward into its position of repose or downward to make its cut is effected by an actuating cylinder 52, the piston rod 53 of which is pivotably connected to the pivotable knife 48. The actuating cylinder 52 may be a compressed air cylinder or another type of actuating device, and is secured at its upper end to frame 22. The actuating cylinder 52 comes into action to pivot the knife 48 downward once the alignment process for both webs 10, 11 is completed, which may be effected via a follow-up control.

As shown in the Figures, the straightener, divided laterally into two segments 54*a*, and 54*b*, is situated upstream of the cutting apparatus 47, as viewed in the take-off direction of the two webs 10, 11 (indicated by arrows in the drawing). However, it should be understood that its position can be changed so long as the cutting apparatus is positioned on the side of the straightener where the web or webs are placed under tension by the aligning and straightening process.

Each straightener segment 54*a*, 54*b* has one aligning strip 55, in which a row of individual aligning shoes 56 are resiliently supported in such a way as to be slightly movable vertically. The aligning shoes 56 are oriented counter to the take-off direction of the webs 10 and 11. Each aligning strip 55 is supported at both ends by a piston rod 57 of two actuating cylinders 58, which can be, for example, compressed air actuating cylinders. Actuating cylinders 58 are each secured to an adjusting nut 59 screwed onto threaded spindles 60, which in turn are screwed into threaded bushings 61 secured to frame 22 via arms 62. A handwheel 63 is secured to the right-hand end of each of the threaded spindles 60, as seen in FIGS. 1 and 2. From the above discussion it should be understood that by suitably turning the threaded spindles 60 by hand, the aligning strips 55, each of which is associated with one of the webs 10, 11, can be adjusted independently of one another in the longitudinal direction of the webs 10, 11, while maintaining a right angle with respect to the longitudinal direction of the webs 10, 11. However, if the webs 10, 11 are quite crooked, it is also possible for the aligning strips 55 to be adjusted somewhat obliquely to the webs 10, 11. Raising the aligning strips 55 and thus aligning shoes 56 into their position of repose and lowering them onto the nap-free bands 12, 13 of the webs 10, 11 is effected by the actuating cylinders 58 associated with each aligning strip 55. The downward motion of the aligning strips 55 in order to set the aligning shoes 56 on the foundation weave 14 of the nap-free bands or lanes 12, 13 of the webs 10, 11 can be activated when scanner devices, such as photoelectric cells, sense the presence of a nap-free lane and then trigger actuation of aligning strip 55. When the nap-free bands 12, 13 on the webs 10 and 11 are of different widths as shown in FIG. 3 and 6, it is necessary that the adjustment of the aligning strips 55 be suitably staggered relative to one another before the straightening and cutting operations begin so that shoes 56 will properly engage the respective bands or lanes. When viewed in the transverse direction of the system as is shown in FIG. 6, this adjustment is made so as to permit the aligning shoes 56 to plunge into the nap free bands of the textile material being drawn from web 10*a* or 11.

To assure that the webs 10, 11 cannot snap back counter to their take-off direction once the cutting operation is completed, a retainer device is provided to engage and hold the web or webs. This retainer device is divided laterally into two segments 64*a*, and 64*b*. Each retainer segment 64*a*, or 64*b* is associated with one web, either 10 or 11. These segments 64*a*, 64*b* also serve to advance the webs 10, 11 by a short distance in the take-off direction, so that the take-off apparatus 17 can engage the webs 10, 11 and initiate an ensuing aligning-/cutting cycle. To this end, the segments 64*a*, 64*b* are actuatable either in common or independently of one another, as will be described below.

The retainer segments 64*a*, 64*b* each have a number of footplates 65 depicted in FIGS. 1–5. Footplates 65 are secured to the free end of lever arm 66. The lever arms 66 are secured to a shaft 67 that is supported on a carriage 68. The carriages 68 are supported separately from one another on the frame 22 such that they can reciprocate parallel to the take-off direction of the webs 10, 11. The reciprocation of each of the carriages 68 is effected by a separate actuating cylinder 69, and these cylinders are situated between each carriage 68 and the frame 22.

Each carriage 68 also has an actuating cylinder 70, the piston rods of each of which are pivotably connected to a respective lever 71. The levers 71 are connected to the shafts 67 in a manner fixed against relative rotation. By means of the actuating cylinders 70, the desired footplates 65 can be pivoted upward or downward, as indicated by the arrows in FIG. 1. The pivoting motion of the footplates 65 in segments 64*a* or 64*b* can take place either in common or independently, which is also true for the reciprocation of the carriages 68 by means of the actuating cylinders 69.

The operation of the system will now be described in connection with textile webs 10, 11 of different widths, which also have different repeat lengths and nap-free bands 12, 13 of different widths.

At the beginning of the alignment and cutting operation, the ends of two webs 10, 11 are engaged or clamped by the take-off apparatus 17 and pulled from their bolts 18, 19 or other source of supply by an identical, predetermined length, in the course of which they travel over a roller 9 rotatably supported on the frame 12 and slide over a bed plate 8, likewise secured to the frame 22. The take-off clamps 25 grasp the webs 10, 11 in the vicinity of their cut edges, and via the drive motor 34 the take-off apparatus 17 is moved to the left, as seen in FIGS. 1 and 2, into its outset position. As soon as the take-off apparatus 17 reaches this position, the additional take-off segments 37*a*, 37*b* begin to function (tripped by a follow-up control, for instance). In the course of the downward motion of the drop bars 38, the webs 10, 11 are pulled into the chute 42, by different extents corresponding to the various repeat lengths desired for each of the respective webs, each forming a fold. This additional take-off is controlled by the scanner elements 41 scanning the nap-free bands 12, 13. Before the drop bars 38 finish their downward motion, one of the nap-free bands or lanes 12, 13 is located beneath each of the aligning strips 55. The strips are lowered so that their aligning shoes 56 are placed on the foundation weave 14 of the nap-free bands 12, 13. The lowering of the aligning strips 55 is controlled by the scanner elements 41 scanning the nap-free bands 12, 13. This situation is shown in FIG. 6. During the remainder of the downward motion of the drop bars 38, the misaligned webs 10, 11 are correspondingly pulled farther downward and in the process straightened by the aligning shoes 56, which for this purpose come into contact successively with the edges 16 of the terry or pile on nap-free bands 12 and 13. The edge of the pile yarns form stops which cooperate with and become engaged by the aligning shoes 56 progressively across the width of the fabric as relative movement between the lanes 12/13 and the shoes 56 occurs due to the drive imparted to the fabric by the downward movement of bars 38. Once each of the shoes 56 engages the edge 16 across the width of the fabric and the webs 10, 11 have been straightened and the nap-free bands 12, 13 are each in alignment in the center with the cutting apparatus 47, and its knives 48, 50 (see also FIG. 7), then the correct repeat length in each case will also have been drawn off by the bars 38. Downward motion of the bars 38 will then have been completed. As already noted, this state is ascertained by the scanner element 41, which reverse the actuating cylinders 40. Before the aligning strips 55 are raised by the actuating cylinders 58, the retainer segments 64*a*, 64*b* come into operation. Lever arms 66 are pivoted downward thus placing the footplates 65 against the webs 10, 11 by the actuating cylinders 70, in order to press the webs against the bed plate 8. At the same time, the transport strips 46 are moved downward against the webs 10, 11, in order to press the webs against the bearing segments 45 of the bent sheets 44. Then the knife 48 is pivoted downward by the actuating cylinder 52, and in cooperation with the stationary knife 50 cuts off the drawn pieces of fabric 10', 11'. Once the cut is made, the knife 48 is immediately pivoted back upward into its outset position.

Once the take-off clamps 25 have been pivoted upward by the actuating cylinder 35, the cut edges on the left, as seen in FIGS. 1 and 2, of the fabric pieces 10' and 11' are free. After the drop bars 38 have been raised to their outset position, the transport strips 46 move the now aligned and cut fabric pieces 10' and 11' out of the aligning and cutting portion of the system toward sewing and folding stations, not shown, in which the two cut edges of the pieces 10' and 11' are sewn.

Accordingly, each time a new cycle begins the drop bars 38 are in a raised position, and the knife 48 and the aligning strips 55 are also in their upper outset positions, and the returned transport strips 46 are raised as well. The still-lowered lever arms 66 and their footplate 65 are moved in common by actuating cylinders 69 in the take-off direction of the webs 10, 11 to move webs 10, 11 a suitable distance so that the cut edge can then be grasped by the take-off apparatus 17, and moved toward the right as seen in FIGS. 1 and 2. This motion of the take-off apparatus 17 is effected by the drive motor 34, now turning in the opposite direction. Once the webs 10, 11 have been handed over to the take-off apparatus 17, the footplates 65 are raised and returned to their outset positions via the actuating cylinders 69. The above-described operating sequences are then repeated to perform another alignment and cutting operation.

Figure 8:
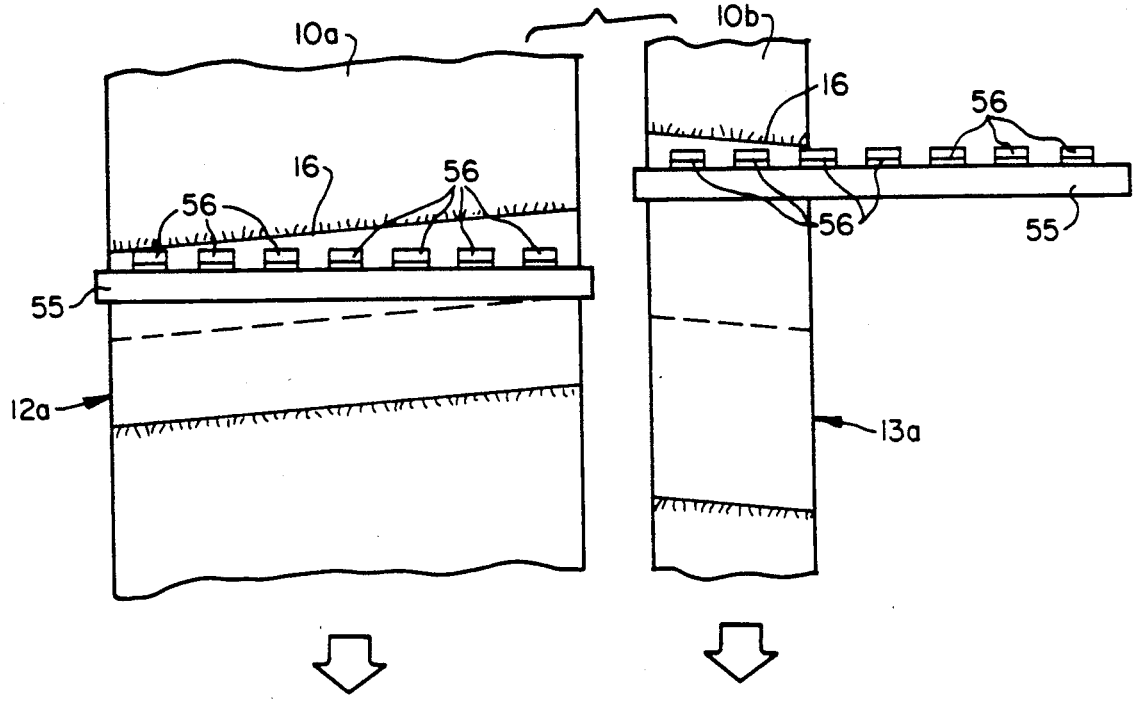
FIGS. 8 and 9 are plan views and are similar to FIGS. 6 and 7, but depict two textile webs of considerably different width and with the alignment strips being highly staggered.
Figure 9:
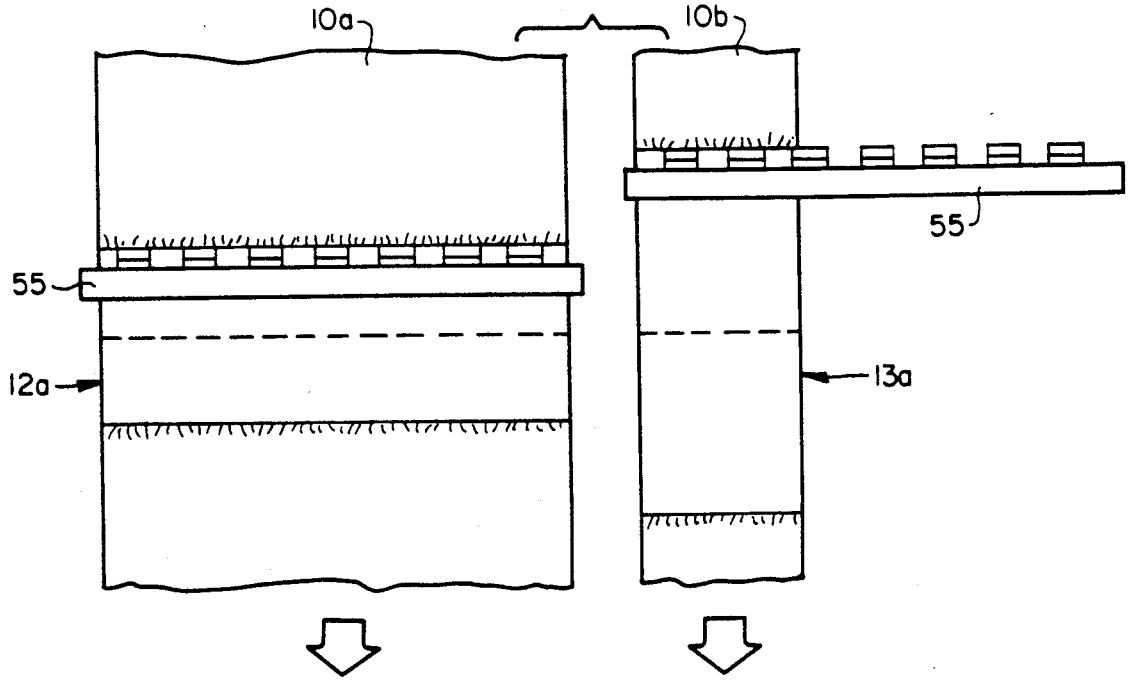

From FIG. 3 it can be seen that the retainer segments 64*a* and 64*b* can be adjusted in staggered fashion. This staggered arrangement is provided for adapting the system to the different widths of the nap-free bands 12, 13. The aligning strips 55 of the segments 54*a*, 54*b* of the straightener may also be staggered. This mutually staggered adjustment of the aligning strips 55 is effected by suitable turning of the hand wheels 63. These different adjusted positions of the aligning strips 55 are emphasized even more in FIGS. 8 and 9, because in this case the widths of the nap-free bands 12*a*, 13*a* of the webs 10*a* and 10*b* differ more significantly than in the webs 10, 11 shown in FIGS. 1–3 and 6–7.

Figure 4:
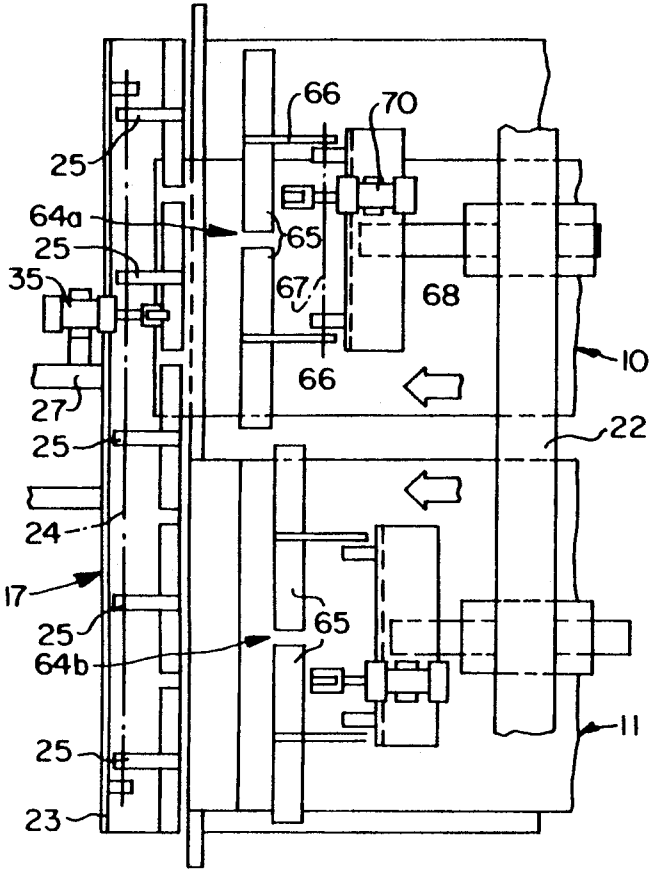

As already mentioned, each segment 64*a* and 64*b* of the retainer has its own actuating cylinder 69, and therefore the two lever arms 66 with the footplates 65 of each segment 64*a*, 64*b* can also be displaced independently of one another in the take-off direction of the webs 10, 11. This is important if, as shown in FIGS. 4 and 5, a flawed piece of fabric 10″ is to be cut from the web 10 and set aside, while the other web 11 is inactive. In this case, the footplates 65 of segment 64*b* of the retainer remain in their retaining position (FIG. 4), as a result of their actuating cylinder 69 not being activated. The actuating cylinder 69 of the segment 64*a*, however, does come into operation, displacing the web 10 by a predetermined length in the take-off direction sufficient to permit the textile to be grasped by the take-off apparatus 17 and drawn off, as shown in FIG. 5. After that, textile from web 10 is drawn off an additional length by the drop bar 38 of the segment 37*a* and aligned by the segment 54*a* of the straightener. The piece of fabric 10″, which has defects along one long edge, as is indicated at "y" in FIG. 5, is then cut from the web 10 by the cutting apparatus 47 and removed from the system.

The system shown in FIGS. 1–3 is also suitable, if needed, for alignment and cutting of only a single web 10*c* (FIGS. 10 and 11) having crooked nap-free bands 12*c*. In that case, the drop bars 38 are moved downward synchronously by the same extent, and the aligning strips 55 of the segments 54*a* and 54*b* are laterally aligned and synchronously actuated. The segments 64*a* and 64*b* of the retainer are also laterally aligned and simultaneously put into operation. FIG. 10 shows the state of a nap-free band 12*c* prior to the alignment, and FIG. 11 shows it after the alignment process. The straight cut can then be made by the cutting apparatus 47 along the dashed line in the middle of the nap-free band 12*c* (see FIG. 11).

Although the system selected as an exemplary embodiment is intended for two textile webs 10, 11, it is also within the scope of the invention to embody such systems for the processing more than two webs.

With the single-web mode of operation, a further advantage is attained: Since the aligning strips 55 have four adjustment points, not only the two outer long edges of the web but also the middle region can be acted upon to the required extent. For example, if the aligning strips 55 are adjusted such that they form a flat V pointing with its apex either in the direction of transport or counter thereto, then it is possible to pull the outer edges of the webs forward to a greater extent, or conversely to leave the outer edges behind and pull the middle region farther forward.

While the invention has been described in connection with what is presently considered to be the most practical and preferred embodiment, it is to be understood that the invention is not to be limited to the disclosed embodiment, but on the contrary, is intended to cover various modifications are equivalent arrangements included within the spirit and scope of the appended claims.

What is claimed is:

1. A system for aligning and cutting one or more sheets of fabric comprising a plurality of fabric supplies, a fabric pull-off assembly operationally associated fabric supplies, drive means for driving the fabric pull-off assembly in a pull-off direction between extended and retracted positions, table means for supporting the sheets of fabric pulled from said plurality of fabric supplies in a laterally spaced apart manner, a first fabric holding assembly extending across said table means and serving to hold the fabric pulled from said plurality of fabric supplies on said table means and to move the fabric in a direction transverse to the pull-off direction whereby aligned and cut fabric can be removed from the system, a cutting knife movably connected to and extending across said table means transversely to the fabric pull-off direction and across the fabric pulled from said plurality of fabric supplies, means for actuating and moving the cutting knife, a fabric adjustment means independently operable with each fabric supply and, spaced apart laterally across said table means for engaging the fabric and adjusting the quantity of fabric removed from each fabric supply, independently operable aligning means for each fabric supply for aligning and straightening the fabric removed from each fabric supply, and control means for independently controlling the operation of each fabric adjustment means and each aligning means whereby said aligning means and said adjustment means cooperate to align and straighten said fabric pulled from each fabric supply.

2. A system according to claim 1, wherein the laterally spaced aligning means are disposed in the longitudinal direction of the one or more sheets of fabric and are adjustable independently of one another.

3. A system according to claim 2, wherein said aligning means are independently movable to angles oblique to said one or more sheets of fabric.

4. A system according to claim 1, further including laterally spaced apart retainer members positioned adjacent said aligning means, said retainer members serving to hold the fabric on said table during cutting operations and being actuatable in common or independently of one another.

5. A method of unwinding and cutting individual lengths of fabric from a plurality of fabric supplies, the fabric having alternatively arranged lanes that differ in thickness and extend crosswise to the longitudinal direction of the fabric, comprising the steps of substantially simultaneously pulling off predetermined lengths of fabric from each of said plurality of fabric supplies and across a table in a laterally spaced apart manner, sensing a lower thickness lane in each of the plurality of fabric lengths, engaging the sensed lower thickness lane in each of the plurality of fabric lengths with a predetermined engaging force at a plurality of spaced apart locations across a width of each of said plurality of fabric lengths, substantially simultaneously pulling off separate, predetermined additional lengths of fabric from each of the plurality of fabric supplies, substantially simultaneously tensioning the individual lengths of fabric to permit a gradual alignment of each fabric length across its width, simultaneously cutting each of the aligned fabric lengths at a desired position in the lower thickness lane and transporting each of the cut lengths away from the aligning and cutting areas.

6. A method as in claim 5 wherein the step of pulling off predetermined lengths pulls off different lengths from said plurality of fabric supplies.

7. A method as in claim 5 wherein the fabric contained on said plurality of fabric supplies have different widths.

8. A system for substantially simultaneously aligning and cutting a plurality of lengths of fabric having alternately arranged, crosswise extending, lanes that differ in thickness comprising:

at least first and second fabric supplies positioned adjacent one another for supplying separate lengths of fabric, respectively;

a fabric pull-off assembly in operational association with said at least first and second fabric supplies to pull off predetermined lengths of fabric therefrom in a pull-off direction;

drive means for driving the fabric pull-off assembly in a pull-off direction between extended and retracted positions;

table means for supporting the fabric;

a cut fabric removal means extending across said table means for engaging the fabric on said table means and to move the fabric in a direction transverse to the pull-off direction following cutting so that aligned and cut fabric can be removed from the system;

cutting means extending transversely across said table means and co-operating with said table means for cutting the fabric following alignment;

a first fabric adjustment means for engaging the fabric pulled off the first fabric supply and for pulling off additional fabric from said first fabric supply in the pull-off direction, a second fabric adjustment means for engaging the fabric pulled off the second fabric supply and for pulling off a predetermined quantity of additional fabric from said second fabric supply in the pull-off direction;

aligning means for aligning the fabric removed from the first fabric supply;

separate aligning means for aligning the fabric removed from the second fabric supply;

a plurality of laterally spaced apart retainer members positioned adjacent each of said aligning means, said retainer members serving to hold the fabric drawn from the first and second fabrics supplies on said table means during cutting operations and being actuatable in common or independently of one another; and control means for independently controlling the operation of said system so that the aligning means associated with each of said at least first and second fabric supplies cooperate to substantially simultaneously align and straighten fabric pulled-off from said at least first and second fabric supplies and then the aligned fabric is cut and removed from the system.

* * * * *